US010011885B2

(12) United States Patent
Kennedy et al.

(10) Patent No.: US 10,011,885 B2
(45) Date of Patent: Jul. 3, 2018

(54) METHODS FOR PRODUCING TITANIUM AND TITANIUM ALLOY ARTICLES

(71) Applicant: ATI PROPERTIES LLC, Albany, OR (US)

(72) Inventors: Richard L. Kennedy, Monroe, NC (US); Robert M. Davis, Marshville, NC (US); Rex W. Bradley, Monroe, NC (US); Robin M. Forbes Jones, Charlotte, NC (US)

(73) Assignee: ATI PROPERTIES LLC, Albany, OR (US)

( * ) Notice: Subject to any disclaimer, the term of this patent is extended or adjusted under 35 U.S.C. 154(b) by 312 days.

(21) Appl. No.: 15/018,337

(22) Filed: Feb. 8, 2016

(65) Prior Publication Data

US 2016/0230239 A1 Aug. 11, 2016

Related U.S. Application Data

(60) Provisional application No. 62/114,194, filed on Feb. 10, 2015.

(51) Int. Cl.
*C21D 3/06* (2006.01)
*B22D 21/02* (2006.01)
(Continued)

(52) U.S. Cl.
CPC ..... *C21D 3/06* (2013.01); *B22D 21/022* (2013.01); *C21D 1/773* (2013.01); *C21D 8/00* (2013.01);
(Continued)

(58) Field of Classification Search
CPC ..... C21D 3/06; C21D 1/773; C21D 8/00
See application file for complete search history.

(56) References Cited

U.S. PATENT DOCUMENTS 2,892,742 A 6/1959 Zwicker et al.
4,680,063 A 7/1987 Vogt et al.
(Continued)

FOREIGN PATENT DOCUMENTS

EP 0 411 537 A1 2/1991
EP 0 434 069 A1 6/1991

OTHER PUBLICATIONS

Yuehong et al., "Influence of melt hydrogenation during induction skull melting process on the solidification microstructure of Ti—6Al—4V alloy", China Foundry, May 1, 2010, vol. 7, No. 2, pp. 109-112.
(Continued)

*Primary Examiner* — Scott R Kastler
(74) *Attorney, Agent, or Firm* — K&L Gates LLP

(57) ABSTRACT

A method of producing an article selected from a titanium article and a titanium alloy article comprises melting feed materials with a source of hydrogen to form a molten heat of titanium or a titanium alloy, and casting at least a portion of the molten heat to form a hydrogenated titanium or titanium alloy ingot. The hydrogenated ingot is deformed at an elevated temperature to form a worked article comprising a cross-sectional area smaller than a cross-sectional area of the hydrogenated ingot. The worked article is dehydrogenated to reduce a hydrogen content of the worked article. In certain non-limiting embodiments of the method, the dehydrogenated article comprises an average α-phase particle size of less than 10 microns in the longest dimension.

22 Claims, 1 Drawing Sheet

(51) Int. Cl.

| | |
|---|---|
| ***C21D 1/773*** | (2006.01) |
| ***C21D 8/00*** | (2006.01) |
| ***C22C 1/02*** | (2006.01) |
| ***C22C 1/06*** | (2006.01) |
| ***C22C 14/00*** | (2006.01) |
| ***C22F 1/18*** | (2006.01) |

(52) U.S. Cl.

CPC ..... *C22C 1/02* (2013.01); *C22C 1/06* (2013.01); *C22C 14/00* (2013.01); *C22F 1/183* (2013.01)

(56) References Cited

U.S. PATENT DOCUMENTS

| | | | | |
|---|---|---|---|---|
| 4,820,360 | A | 4/1989 | Eylon et al. | |
| 5,108,517 | A * | 4/1992 | Kimura | C22C 14/00 148/527 |
| 7,611,592 | B2 | 11/2009 | Davis et al. | |
| 2016/0230239 | A1* | 8/2016 | Kennedy | C21D 3/06 |

OTHER PUBLICATIONS

Banerjee S. and P. Mukhopadhyay, "Phase Transformations, Examples from Titanium and Zirconium Alloys", Elsevier, 2007, pp. 737-741.

Froes et al., "Thermochemical Processing of Titanium Alloys", JOM, Mar. 1990, pp. 26-29.

Kerr et al., "Hydrogen as an Alloying Element in Titanium (Hydrovac)", Titanium '80 Science and Technology, 1980, pp. 2477-2486.

Kerr, William R., "The Effect of Hydrogen as a Temporary Alloying Element on the Microstructure and Tensile Properties of Ti—6Al—4V", Metallurgical Transactions A, vol. 16A, Jun. 1985, pp. 1077-1087.

Kolatchev et al., "The Effect of Hydrogen Alloying on Workability of Titanium Alloys", Titanium '92, Science and Technology, Edited by F. H. Froes and I. Caplan, The Minerals, Metals & Materials Society, 1993, pp. 861-869.

Lenning, G. A. and R. I. Jaffee, "Report on Effect of Hydrogen on the Properties of Titanium and Titanium Alloys", TML Report No. 27, Dec. 27, 1955, Office of Assistant Secretary of Defense for Research and Development, Titanium Metallurgical Laboratory, Battelle Memorial Institute, Columbus, Ohio, pp. 73-74.

Niinomi et al., "Fracture Characteristics of Ti—6Al—4V and Ti—5Al—2.5Fe with Refined Microstructure Using Hydrogen", Metallurgical and Materials Transactions A, vol. 26A, May 1995, pp. 1141-1151.

Niu, Y. and Miaoquan Li, "Application of Thermohydrogen Processing for Formation of Ultrafine Equiaxed Grains in Near α Ti600 Alloy", Metallurgical and Materials Transactions A, vol. 40A, Dec. 2009, pp. 3009-3015.

Niu et al., "High-Temperature Deformation Behavior of Ti—6Al—4V Alloy without and with Hydrogenation Content of 0.27 wt.%", Journal of Materials Engineering and Performance, vol. 19(1) Feb. 2010, pp. 59-63.

Weiss et al., "Modification of Alpha Morphology in Ti—6Al—4V by Thermomechanical Processing", Metallurgical Transactions A, vol. 17A, Nov. 1986, pp. 1935-1947.

Yoshimura et al., "Ultra-fine Equiaxed Grain Refinement of Titanium Alloys by Hydrogenation, Hot Working, Heat Treatment and Dehydrogenation", Nippon Steel Technical Report No. 62, Jul. 1994, pp. 80-84.

* cited by examiner

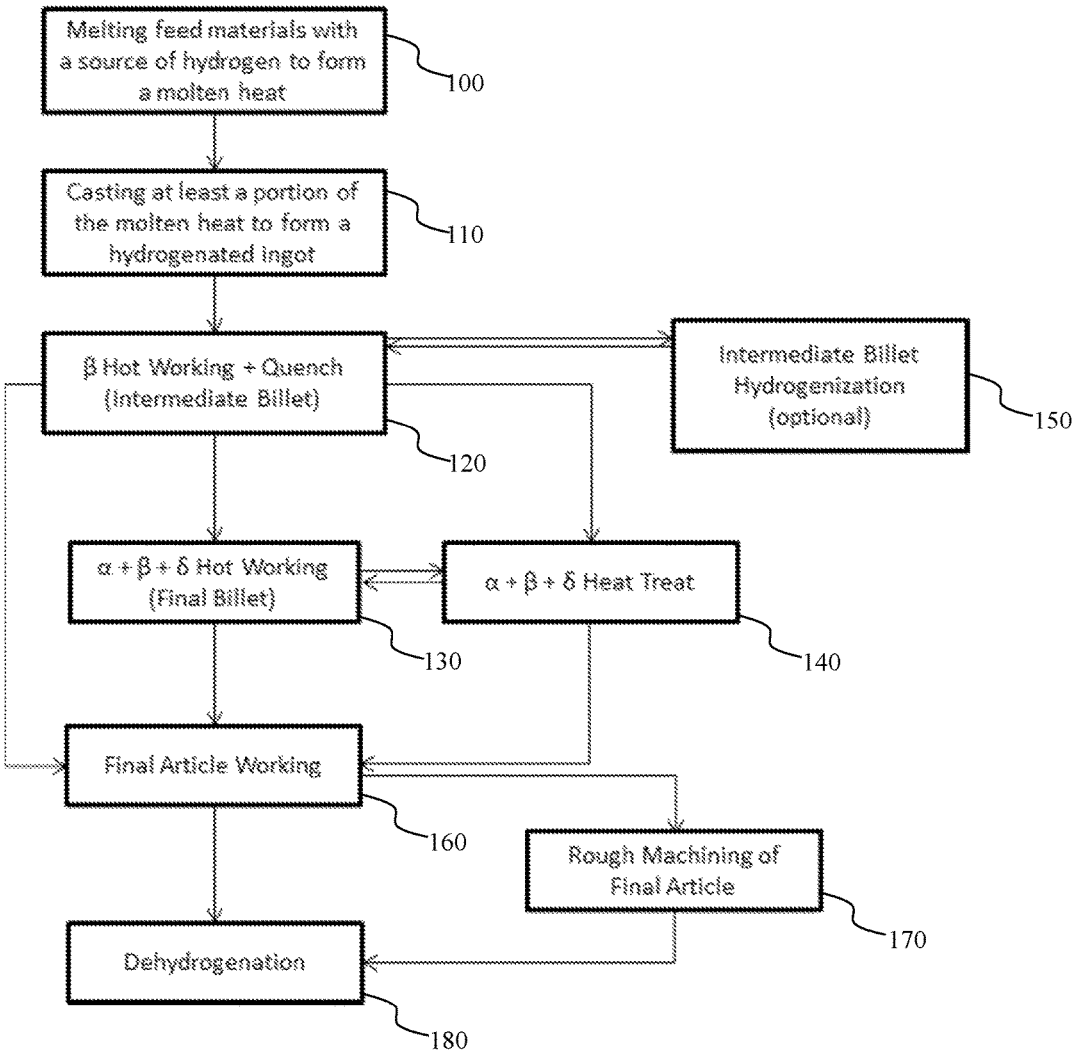
Melting feed materials with a source of hydrogen to form a molten heat
100
Casting at least a portion of the molten heat to form a hydrogenated ingot
110
β Hot Working + Quench (Intermediate Billet)
120
Intermediate Billet Hydrogenization (optional)
150
α + β + δ Hot Working (Final Billet)
130
α + β + δ Heat Treat
140
Final Article Working
160
Rough Machining of Final Article
170
Dehydrogenation
180

METHODS FOR PRODUCING TITANIUM AND TITANIUM ALLOY ARTICLES

CROSS-REFERENCE TO RELATED APPLICATIONS

This patent application claims the benefit of co-pending U.S. Provisional Patent Application Ser. No. 62/114,194, filed on Feb. 10, 2015, which is hereby incorporated herein by reference in its entirety.

BACKGROUND OF THE TECHNOLOGY

Field of Technology

The present disclosure relates to methods for producing titanium and titanium alloy articles. In particular, certain non-limiting aspects of the present disclosure relate to methods including producing a hydrogenated titanium or titanium alloy, deforming (working) the titanium or titanium alloy, and subsequently dehydrogenating the material to reduce the hydrogen content of an article. In certain non-limiting embodiments of the method of the present disclosure, the method provides a titanium or titanium alloy article having an ultra-fine α-phase particle size, e.g., an average α-phase particle size of less than 10 microns in the longest dimension.

Description of the Background of the Technology

Titanium alloys are used in a variety of applications for their advantageous balance of material properties including strength, ductility, modulus, and temperature capability. For example, Ti-6Al-4V alloy (also denoted "Ti-6-4 alloy", having a composition specified in UNS R56400) is a commercial alloy that is widely used in the aerospace and biomedical industries.

Titanium has two allotropic forms: a "high temperature" beta ("β")-phase, which has a body centered cubic ("bcc") crystal structure; and a "low temperature" alpha ("α")-phase, which has a hexagonal close packed ("hcp") crystal structure. The temperature at which the α-phase transforms completely into the β-phase as a titanium alloy is heated is known as the β-transus temperature (or simply "β-transus" or "$T_\beta$"). Conventional processing of cast ingots of titanium alloys to form billets or other mill products generally involves a combination of deformation steps above and below the β-transus depending on the desired structure and material property requirements for a given application.

A finer α particle size can result in higher tensile properties, improved fatigue strength, and improved ultrasonic inspectability for the titanium alloy article. The conventional approach to achieving a finer α particle size in titanium alloy articles usually involves managing complicated thermo-mechanical processing, for example, rapid quenching from the β-phase field followed by relatively large amounts of hot working or strain in the α+β phase region and possibly a post-deformation anneal in the α+β phase region to enhance particle refinement. In particular, to achieve the finest α particle size, hot working at very low, and perhaps marginally practical, temperatures and using relatively low, controlled strain rates is required. However, there are manufacturing limits to what can be achieved with this conventional approach, due to increased forging loads, lower process yields due to cracking, and lack of or limits of practical strain rate control, especially at large section sizes. The conventional approach may also be limited by an increasing tendency to form small voids or pores in the alloy under certain processing conditions such as low temperatures and/or high strain rates. This phenomenon is known as "strain-induced porosity" or "SIP." The presence of SIP in the alloy can be particularly deleterious to the alloy properties and can result in significant process yield loss. In severe cases, additional and costly processing steps, such as hot-isostatic pressing, may be required to eliminate SIP that has formed. Thus, there has developed a need for methods for producing titanium alloy articles having a finer α particle size while avoiding limits imposed by the hot working temperature and/or the strain rate.

SUMMARY

The present disclosure, in part, is directed to methods and alloy articles that address certain of the limitations of conventional approaches for producing titanium alloy articles. Certain embodiments herein address limitations of conventional techniques for achieving a finer α particle size in certain titanium and titanium alloy articles. One non-limiting aspect of the present disclosure is directed to a method of producing an article selected from a titanium article and a titanium alloy article. The method comprises: melting feed materials with a source of hydrogen to form a molten heat of a titanium or titanium alloy; casting at least a portion of the molten heat to form a hydrogenated titanium or titanium alloy ingot; deforming the hydrogenated ingot at an elevated temperature to form a worked article comprising a cross-sectional area smaller than a cross-sectional area of the hydrogenated ingot; and dehydrogenating the worked article to reduce a hydrogen content of the worked article. In certain non-limiting embodiments of the method, the dehydrogenated article comprises an average α-phase particle size of less than 10 microns in the longest dimension. In certain non-limiting embodiments of the method, the titanium or titanium alloy is selected from the group consisting of commercially pure titanium, a near-α titanium alloy, an α+β titanium alloy, a near-β titanium alloy, and a titanium aluminide alloy.

Another non-limiting aspect of the present disclosure is directed to a method of producing an α+β titanium alloy article. The method comprises: melting feed materials with a source of hydrogen to form a molten heat; casting at least a portion of the molten heat to form a hydrogenated ingot of an α+β titanium alloy; deforming the hydrogenated ingot at a temperature initially in a β phase field and subsequently in an α+β+δ phase field to form a worked article comprising a cross-sectional area smaller than a cross-sectional area of the hydrogenated ingot; and vacuum heat treating the worked article to reduce a hydrogen content of the worked article.

Another non-limiting aspect of the present disclosure is directed to a method of producing an α+β titanium alloy article. The method comprises: melting feed materials with a source of hydrogen to form a molten heat; casting at least a portion of the molten heat to form a hydrogenated ingot of an α+β titanium alloy; deforming the ingot at a first elevated temperature to form an initial worked article comprising a cross-sectional area smaller than a cross-sectional area of the hydrogenated ingot; hydrogenating the initial worked article at a second elevated temperature; deforming the initial worked article at a third elevated temperature to form an intermediate worked article having a cross-sectional area smaller than a cross-sectional area of the initial worked article; and vacuum heat treating the intermediate worked article to reduce the hydrogen content of the intermediate worked article.

BRIEF DESCRIPTION OF THE DRAWING

Features and advantages of the methods and alloy articles described herein may be better understood by reference to the accompanying drawings in which:

FIG. 1 is a flow chart of a non-limiting embodiment of a method of producing a titanium or titanium alloy article according to the present disclosure.

It should be understood that the invention is not limited in its application to the arrangements illustrated in the above-described drawing. The reader will appreciate the foregoing details, as well as others, upon considering the following detailed description of certain non-limiting embodiments of methods and alloy articles according to the present disclosure. The reader also may comprehend certain of such additional details upon using the methods and alloy articles described herein.

DETAILED DESCRIPTION OF CERTAIN NON-LIMITING EMBODIMENTS

In the present description of non-limiting embodiments and in the claims, other than in the operating examples or where otherwise indicated, all numbers expressing quantities or characteristics of ingredients and products, processing conditions, and the like are to be understood as being modified in all instances by the term "about." Accordingly, unless indicated to the contrary, any numerical parameters set forth in the following description and the attached claims are approximations that may vary depending upon the desired properties one seeks to obtain in the methods and alloy articles according to the present disclosure. At the very least, and not as an attempt to limit the application of the doctrine of equivalents to the scope of the claims, each numerical parameter should at least be construed in light of the number of reported significant digits and by applying ordinary rounding techniques.

The present disclosure, in part, is directed to methods and titanium and titanium alloy articles that address certain of the limitations of conventional approaches for achieving a finer α particle size in certain titanium alloy articles. Referring to FIG. 1, a non-limiting embodiment of a method of producing an α+β titanium alloy ingot according to the present disclosure is illustrated. The method includes melting feed materials with a source of hydrogen to form a molten heat (block 100), and casting at least a portion of the molten heat to form a hydrogenated (i.e., hydrogen-containing) α+β titanium alloy ingot (block 110). In certain non-limiting embodiments, the feed materials may consist of materials that, once melted, produce a Ti-6-4 titanium alloy (having a composition specified in UNS R56400) comprising, by weight (all percentages herein are weight percentages, unless otherwise indicated), 5.50% to 6.75% aluminum, 3.50% to 4.50% vanadium, titanium, hydrogen, and impurities. Those having ordinary skill may readily identify starting materials capable of forming an alloy heat having a particular desired composition.

More generally, the methods described herein may be used in connection with the preparation of ingots and other articles of any of commercially pure titanium, near-α titanium alloys, α+β titanium alloys, near-β titanium alloys, and titanium aluminide alloys. Non-limiting examples of near-α titanium alloys that can be processed in accordance with various non-limiting embodiments of the methods disclosed herein include Ti-8Al-1Mo-1V alloy (having a composition specified in UNS R54810). Non-limiting examples of α+β titanium alloys that can be processed in accordance with various non-limiting embodiments of the methods disclosed herein include Ti-6Al-2Sn-4Zr-2Mo alloy (having a composition specified in UNS R54620), Ti-6Al-4V alloy (having a composition specified in UNS R56400), and Ti-6Al-6V-2Sn alloy (having a composition specified in UNS R56620). Non-limiting examples of near-β titanium alloys that can be processed in accordance with various non-limiting embodiments of the methods disclosed herein include Ti-5Al-2Sn-2Zr-4Mo-4Cr alloy (also denoted "Ti-17" alloy, having a composition specified in UNS-R58650), Ti-6Al-2Sn-2Zr-2Cr-2Mo-0.15Si alloy (also denoted "Ti-62222" alloy), and Ti-4.5Al-3V-2Mo-2Fe alloy (also denoted "SP-700" alloy). Non-limiting examples of titanium aluminide alloys that can be processed in accordance with various non-limiting embodiments of the methods disclosed herein include Ti-24Al-11Nb alloy and super-α2 based Ti-25Al-10Nb-3V-1Mo alloy. It will be appreciated by those skilled in the art that the foregoing alloy designations refer only to nominal concentrations, on a weight percent of total alloy weight basis, of certain major alloying elements contained in the titanium alloy, and that these alloys may also include other minor additions of alloying elements, as well as incidental impurities, that do not affect the designation of the alloys as near-α titanium alloys, α+β titanium alloys, near-β titanium alloys, and titanium aluminide alloys. Moreover, although the present description references certain specific alloys, the methods and alloy articles described herein are not limited in this regard. As will be understood, the starting materials may be selected by an ordinarily skilled practitioner so as to provide an alloy ingot having the desired composition and other desired properties.

According to certain non-limiting embodiments, at least a portion of the hydrogenated ingot produced in the melting and casting steps according to the present methods has a hydrogen content greater than 0 to 1.5%, by weight based on the total weight of the hydrogenated ingot. According to certain other non-limiting embodiments, the hydrogen content of at least a portion of the hydrogenated ingot is 0.05% to 1.0%, by weight. In yet other non-limiting embodiments, at least a portion of the hydrogenated ingot has a hydrogen content of 0.05% to 0.8%, or 0.2% to 0.8%, by weight. Depending on the composition for the particular alloy article, a hydrogen content greater than 1.5% by weight may promote cracking during cooling to room temperature and, therefore, may not provide the requisite material properties.

The conventional approach to introducing hydrogen in a titanium alloy article is post-melt, through a heat treatment of the solidified alloy in the presence of hydrogen. This conventional approach relies on solid-state diffusion of hydrogen and, therefore, typically requires a high temperature heat treatment for a lengthy period of time, increasing significantly with section size. In contrast, certain non-limiting embodiments of methods of producing an α+β titanium alloy article or other titanium or titanium alloy articles according to the present disclosure include melting feed materials with a source of hydrogen to provide a hydrogenated titanium or titanium alloy ingot. In other words, a hydrogen source is present during the production of the molten heat and hydrogen from the source is incorporated into the cast material. According to certain non-limiting embodiments, the hydrogen source is present during the melting and casting (solidification) steps, which are performed simultaneously.

The hydrogen may be incorporated into the cast titanium or titanium alloy in the form of, for example, hydride precipitation or interstitial solid solution, in the titanium or titanium alloy matrix, although the hydrogen may be present in any form promoted by the alloy composition and processing conditions. As further explained below, titanium and titanium alloy articles processed according to various embodiments of methods according to the present disclosure can result in improved workability and process yields and thereby decrease production costs, and/or can achieve finer α particle size than is possible via conventional titanium conversion methods. Moreover, as further explained below in connection with certain embodiments herein, by maintaining the hydrogenated state through the final hot worked and rough-machined article, the annealing times needed for dehydrogenation (i.e., reducing hydrogen content) can be relatively short and economically practical.

In certain non-limiting embodiments, the source of hydrogen may be, for example: a gaseous environment comprising a partial pressure of hydrogen in contact with the molten feed materials; a gaseous environment comprising a partial pressure of hydrogen and an inert gas (e.g., helium or argon) in contact with the molten feed materials; and/or one or more hydrogen-containing materials (such as, for example, titanium hydride powder, hydride titanium chips or turnings) that are melted along with other feed materials. Those having ordinary skill, upon reading the present description, may identify additional sources of hydrogen that could be used in methods according to the present disclosure to increase the hydrogen content of a titanium or titanium alloy article. It is intended that all such additional hydrogen sources are within the scope of the present invention.

With continuing reference to FIG. 1, in a non-limiting embodiment of a method of producing an α+β titanium alloy article or another titanium alloy article according to the present disclosure, the hydrogenated titanium alloy ingot is deformed (i.e., worked) at an elevated temperature (i.e., a temperature greater than room temperature and that is suitable for working the ingot) to form a worked article comprising a cross-sectional area smaller than a cross-sectional area of the hydrogenated ingot (blocks 120-140). The meaning of a "worked article" will be readily understood by those having ordinary skill in the production of titanium alloy articles. As examples, and without limitation, a worked article can refer to a preform, an intermediate billet, a final billet, a bar, a plate, a sheet, a final article in either the as-worked or rough-machined condition, or other mill products. For example, once the initial ingot is deformed, e.g., by forging or other hot working techniques, the resulting worked article is typically referred to in the art as a preform or an intermediate billet. A "worked article" as used herein encompasses all such articles. Moreover, it should be understood that a "preform" or a "billet" is not limited to specific shapes of articles. The specific shape of a preform or a billet may vary depending upon the processing conditions and the design criteria of the particular alloy article.

In certain non-limiting embodiments of the present methods, the hydrogenated ingot is deformed at a temperature initially in a β phase field (block 120) of the particular alloy, and is subsequently deformed in an α+β+δ phase field (block 130) of the alloy to form a worked article comprising a cross-sectional area smaller than a cross-sectional area of the hydrogenated ingot. In certain embodiments of the present method involving deformation in the β phase field and subsequently in the α+β+δ phase field, the alloy is an α+β titanium alloy. Conventional processing of cast ingots of α+β alloys to form billets or other mill products typically involves an initial deformation of the material above the β-transus (i.e., in the β phase field) to break up the cast structure of the ingot. Without intending to be bound to any theory, providing an α+β titanium alloy article with an increased hydrogen content using methods according to the present disclosure may improve the hot workability or ductility of the α+β titanium alloy by decreasing the β-transus temperature of the alloy and stabilizing the alloy's β phase.

In certain non-limiting embodiments of methods according to the present disclosure, a titanium or titanium alloy article made by casting a melt produced by melting feed materials with a source of hydrogen is initially deformed at a temperature slightly above the β-transus temperature to form an intermediate billet (block 120). Deforming the titanium or titanium alloy article according to various non-limiting embodiments disclosed herein may involve deforming a portion of the article or the entire article. Further, as used herein, phrases such as "deforming at" and "deforming the body at," etc., with reference to a temperature, a temperature range, or a minimum temperature, mean that at least the portion of the object to be deformed has a temperature at least equal to the referenced temperature, within the referenced temperature range, or at least as high as the referenced minimum temperature during the deformation. Non-limiting examples of methods of deforming the titanium or titanium alloy articles that may be used in accordance with various non-limiting embodiments disclosed herein include one or a combination of forging, cogging, extrusion, drawing, and rolling. For example, according to one specific non-limiting embodiment, deforming at least a portion of the article at a temperature $T_1$ can comprise forging the article at a condition wherein at least a portion of the article is at temperature $T_1$. With regard to α+β titanium alloys, because increasing the hydrogen content of an α+β titanium alloy decreases the β-transus temperature, the temperature of the initial β forging operation can be lower compared to conventional processing, in which the hydrogen content of the alloy may be lower. Utilizing a lower temperature during the initial β forging operation can provide benefits such as minimizing β-grain size and retaining a higher density of dislocations which can facilitate microstructural refinement during subsequent processing.

Still referring to block 120 of FIG. 1, according to certain non-limiting embodiments, subsequent to the initial low-temperature β deformation, the intermediate billet is deformed at a higher β deformation temperature to recrystallize at least a portion of the intermediate billet. For example, subsequent to the initial low-temperature β deformation, the intermediate billet can be forged at a temperature ($T_2$) that is higher than the temperature of the initial β forging operation ($T_1$). In certain non-limiting embodiments, $T_2$ is at least 27° C. greater than $T_1$. For example, according to various non-limiting embodiments disclosed herein, prior to deforming the ingot in the β phase field at $T_1$, the intermediate billet may be heated to $T_1$, or a temperature above $T_1$, for example, in a furnace, such that the intermediate billet, or at least the portion of the intermediate billet to be deformed, attains a temperature of at least $T_1$. As used herein, terms such as "heated to" and "heating to," etc., with reference to a temperature, a temperature range, or a minimum temperature, mean that the article is heated until at least the desired portion of the article has a temperature at least equal to the referenced or minimum temperature, or within the referenced temperature range throughout the portion's extent. After heating, the intermediate billet (or any portion thereof) can be deformed at $T_1$.

According to certain non-limiting embodiments, the hydrogen-containing intermediate billet formed from the melt is cooled to form hydride precipitates in the intermediate billet. The hydrogen content of the hydrogenated ingot can promote a eutectoid phase transformation of the form β ↔ α+β+δ (titanium hydride) when held at a temperature in an α+β+δ phase region. As used herein, phrases such as "hold at" and the like, with reference to a temperature, temperature range, or minimum temperature, mean that at least a desired portion of the titanium or titanium alloy is maintained at a temperature at least equal to the referenced or minimum temperature, or within the referenced temperature range. In certain non-limiting embodiments, the titanium or titanium alloy is cooled in a controlled manner through the eutectoid transus to room temperature. Alternatively, the material is cooled in a controlled manner to below the eutectoid transus, held (aged) at a temperature or in temperature range below the eutectoid transus for a period of time to develop a more homogeneous distribution of hydrogen, and then cooled in a controlled manner to room temperature. The δ-phase precipitates can be used to refine the α+β microstructure and potentially facilitate the formation of a finer α particle size compared to conventional processing, as further explained below. Although the present description references α+β titanium alloys, the methods and alloy articles described herein are not limited in this regard. It is to be appreciated that, in other non-limiting embodiments of methods according to the present disclosure, various modifications can be made without departing from the spirit and scope of the disclosure as will be apparent to those skilled in the art. Such changes and modifications are within the scope and teachings of this disclosure as defined in the claims appended hereto.

With continuing reference to FIG. 1, the intermediate billet is hot worked, i.e., deformed at a temperature in an α+β+δ phase field or region of the α+β titanium alloy, to form a final billet (block 130). In certain non-limiting embodiments, the intermediate billet is aged at a temperature in an α+β+δ phase field of the titanium alloy (block 140) before the deformation in the α+β+δ phase region or field of the titanium alloy. In other non-limiting embodiments, the intermediate billet is deformed in the α+β or α+β+δ phase field of the titanium alloy without a separate aging step in the α+β+δ phase field of the titanium alloy.

In certain non-limiting embodiments, the hydrogenated ingot is cylindrical. In further embodiments, the hydrogenated ingot may assume other geometric forms, and the cross-section may be, for example, roughly rectangular. According to certain non-limiting embodiments disclosed herein, deforming the hydrogenated ingot into the final billet may comprise deforming or otherwise working the ingot in one or more passes or steps, to attain a total percent reduction in cross-sectional area of at least 15% up to 98% during the hot working.

According to certain non-limiting embodiments involving processing of a Ti-6-4 titanium alloy article, the temperature in the α+β+δ phase region of the α+β titanium alloy at which the ingot is worked (block 130) is less than 800° C. The δ-phase hydride precipitates formed in embodiments herein may facilitate the formation of a finer α particle size compared to conventional processing. Without intending to be bound to any theory, the δ-phase hydride precipitates can act as nucleation sites for recrystallization of the α phase during the hot working, and also can act as pinning sites to stabilize the refined α particles.

According to certain non-limiting embodiments, a method of producing a Ti-6-4 titanium alloy article according to the present disclosure comprises deforming a hydrogenated ingot cast from an ingot prepared using a hydrogen source as described herein, at a first elevated temperature to form an initial worked article comprising a cross-sectional area smaller than a cross-sectional area of the hydrogenated ingot, and hydrogenating the initial worked article at a second elevated temperature (block 150). In certain non-limiting embodiments, hydrogenation during melt processing (block 100) is used to increase hydrogen to an intermediate content lower than a desired final content, and the balance of the desired hydrogen is then added to hydrogenate the alloy by a subsequent short-time, high-temperature heat treatment applied, for example, after the β forge. The further hydrogenated alloy may be additionally processed to precipitate titanium hydride particles as detailed above.

With continuing reference to FIG. 1, the final billet is additionally worked by conventional or superplastic methods in the α+β or α+β+δ field to form an article having the desired final shape (block 160) and/or rough-machined (block 170). According to certain non-limiting embodiments involving processing of a Ti-6-4 titanium alloy article, final α+β+δ forging may be done at a temperature of less than 850° C. to 650° C. During conventional processing, without the partial temporary hydrogenation conducted in the methods according to the present disclosure, hot working a Ti-6-4 titanium alloy at temperatures well below the β-transus can disadvantageously lead to excessive cracking and large amounts of strain induced porosity.

According to certain non-limiting embodiments, the final article provided is dehydrogenated (block 180) in either the as-worked or rough machined condition to reduce a hydrogen content of the final article. As used herein, "dehydrogenating" means to reduce the hydrogen content of the final article to any degree. In certain non-limiting embodiments, dehydrogenating the article reduces the hydrogen content to no greater than 150 ppm. In certain non-limiting embodiments, dehydrogenating the final article may reduce hydrogen content in the final article to any suitable reduced hydrogen content to inhibit or avoid low temperature embrittlement and/or to meet industry standard chemistry specifications for the particular alloy. During the dehydrogenation process, the δ-phase (titanium hydride) precipitates may decompose and leave behind a relatively fine α+β microstructure with morphologies that range from slightly acicular to equiaxed, depending on processing conditions.

In certain non-limiting embodiments, the dehydrogenation treatment produces a dehydrogenated worked article. In various non-limiting embodiments, the dehydrogenated worked article comprises an average α-phase particle size less than 10 microns in the longest dimension. In further non-limiting embodiments, the dehydrogenated worked article can comprise an average α-phase particle size of less than 3 microns in the longest dimension. In further non-limiting embodiments, the dehydrogenated worked article can comprise an average α-phase particle size of less than 1 micron in the longest dimension. The refined α+β microstructure can improve the mechanical properties of the final article and/or improve ultrasonic inspectability. One ordinarily skilled in the art can readily determine the α-phase particle size for the dehydrogenated worked article by microscopy.

According to certain non-limiting embodiments, dehydrogenating the article includes vacuum heat treating the article. In certain non-limiting embodiments, vacuum heat treating the article comprises heating the final article in substantial vacuum at a temperature sufficient to remove at least a portion of hydrogen from the article. Although only a limited number of methods of dehydrogenation are described herein, the present invention is not so limited. Those having ordinary skill may readily determine a suitable dehydrogenation technique for a particular hydrogenated worked article.

Maintaining the titanium or titanium alloy article in its hydrogenated state all the way to a final worked or rough-machined condition can result in numerous process advantages including, for example, improved yield (less cracking), lower forging flow stresses, lower allowable hot working temperatures, improved machinability, and significantly reduced dehydrogenation annealing times. The changed process conditions can produce a final titanium or titanium alloy article with an ultra-fine structure and improved tensile strength, fatigue resistance, and ultrasonic inspectability.

Although the foregoing description has necessarily presented only a limited number of embodiments, those of ordinary skill in the relevant art will appreciate that various changes in the methods and other details of the examples that have been described and illustrated herein may be made by those skilled in the art, and all such modifications will remain within the principle and scope of the present disclosure as expressed herein and in the appended claims. It is understood, therefore, that the present invention is not limited to the particular embodiments disclosed or incorporated herein, but is intended to cover modifications that are within the principle and scope of the invention, as defined by the claims. It will also be appreciated by those skilled in the art that changes could be made to the embodiments above without departing from the broad inventive concept thereof.

We claim:

1. A method of producing a titanium alloy article, the method comprising:

melting feed materials with a source of hydrogen comprising titanium hydride to form a molten heat of a titanium alloy;

casting at least a portion of the molten heat to form a hydrogenated titanium alloy ingot;

deforming the hydrogenated ingot at an elevated temperature initially in a β phase field to form a worked article comprising a cross-sectional area smaller than a cross-sectional area of the hydrogenated ingot;

cooling the worked article from the β phase field to room temperature;

aging the worked article at a temperature in an α+β+δ phase field of the titanium alloy;

deforming the worked article in the α+β+δ phase field; and dehydrogenating the worked article to reduce a hydrogen content of the worked article.

2. The method of claim 1, wherein the titanium alloy article is selected from the group consisting of a near-α titanium alloy article, an α+β titanium alloy article, a near-β titanium alloy article, and a titanium aluminide alloy article.

3. The method of claim 1, wherein at least a portion of the hydrogenated ingot has a hydrogen content of 0.05% to 1.5%, by weight.

4. The method of claim 1, wherein at least a portion of the hydrogenated ingot has a hydrogen content greater than 0 up to 0.8%, by weight.

5. The method of claim 1, wherein at least a portion of the hydrogenated ingot has a hydrogen content of 0.2% to 0.8%, by weight.

6. The method of claim 1, wherein the source of hydrogen comprises at least one of a gaseous environment comprising a partial pressure of hydrogen, and a gaseous environment comprising a partial pressure of hydrogen and an inert gas.

7. The method of claim 1, wherein melting feed materials comprises melting the feed material in a gaseous environment comprising a partial pressure of hydrogen.

8. The method of claim 1, wherein at least one of the deforming the hydrogenated ingot and the deforming the worked article comprises at least one of forging and rolling.

9. The method of claim 1, wherein dehydrogenating the worked article comprises heating the worked article in substantial vacuum at a temperature sufficient to remove at least a portion of hydrogen from the worked article.

10. The method of claim 1, wherein dehydrogenating the worked article reduces the hydrogen content to no greater than 150 ppm.

11. The method of claim 1, wherein the dehydrogenated worked article comprises an average α-phase particle size of less than 10 microns in the longest dimension.

12. The method of claim 1, wherein the dehydrogenated worked article comprises an average α-phase particle size of less than 3 microns in the longest dimension.

13. The method of claim 1, wherein the dehydrogenated worked article comprises an average α-phase particle size of less than 1 micron in the longest dimension.

14. The method of claim 1, wherein the article is an α+β titanium alloy article and the α+β titanium alloy comprises, by weight, 5.50% to 6.75% aluminum, 3.50% to 4.50% vanadium, titanium, hydrogen, and impurities.

15. A method of producing an α+β titanium alloy article, the method comprising:

melting feed materials with a source of hydrogen comprising titanium hydride to form a molten heat;

casting at least a portion of the molten heat to form a hydrogenated ingot of an α+β titanium alloy;

deforming the hydrogenated ingot at a first elevated temperature to form an initial worked article comprising a cross-sectional area smaller than a cross-sectional area of the hydrogenated ingot;

hydrogenating the initial worked article at a second elevated temperature;

deforming the initial worked article at a third elevated temperature in an α+β+δ phase field to form an intermediate worked article having a cross-sectional area smaller than the cross-sectional area of the initial worked article; and vacuum heat treating the intermediate worked article to reduce a hydrogen content of the intermediate worked article.

16. The method of claim 15, wherein the α+β titanium alloy comprises, by weight, 5.50% to 6.75% aluminum, 3.50% to 4.50% vanadium, titanium, hydrogen, and impurities.

17. The method of claim 15, wherein the source of hydrogen comprises at least one of a gaseous environment comprising a partial pressure of hydrogen, and a gaseous environment comprising a partial pressure of hydrogen and an inert gas.

18. The method of claim 15, wherein vacuum heat treating the intermediate worked article comprises heating the intermediate worked article at a temperature sufficient to remove at least a portion of hydrogen from the intermediate worked article.

19. The method of claim 15, wherein vacuum heat treating the intermediate worked article reduces the hydrogen content of the intermediate worked article to no greater than 150 ppm.

20. The method of claim 15, wherein the vacuum heat treated intermediate worked article comprises an average α-phase particle size of less than 10 microns in the longest dimension.

21. The method of claim 15, wherein the vacuum heat treated intermediate worked article comprises an average α-phase particle size of less than 3 microns in the longest dimension.

22. The method of claim 15, wherein the vacuum heat treated intermediate worked article comprises an average α-phase particle size of less than 1 micron in the longest dimension.

* * * * *